US008235314B2

(12) United States Patent
Lee

(10) Patent No.: US 8,235,314 B2
(45) Date of Patent: Aug. 7, 2012

(54) NONEQUILIBRIUM HUMIDITY CONTROL FOR JET MILLING

(75) Inventor: Ron C. Lee, Bloomsbury, NJ (US)

(73) Assignee: Linde Aktiengesellschaft, Munich (DE)

( * ) Notice: Subject to any disclaimer, the term of this patent is extended or adjusted under 35 U.S.C. 154(b) by 105 days.

(21) Appl. No.: 12/702,612

(22) Filed: Feb. 9, 2010

(65) Prior Publication Data

US 2010/0200681 A1 Aug. 12, 2010

Related U.S. Application Data

(60) Provisional application No. 61/152,047, filed on Feb. 12, 2009.

(51) Int. Cl.
*B02C 19/06* (2006.01)

(52) U.S. Cl. ..... 241/5

(58) Field of Classification Search ..... 241/5, 39
See application file for complete search history.

(56) References Cited

U.S. PATENT DOCUMENTS 6,230,995 B1 * 5/2001 Niemi et al. ..... 241/5
2009/0137732 A1 * 5/2009 Panz et al. ..... 524/588

* cited by examiner

*Primary Examiner* — Mark Rosenbaum
(74) *Attorney, Agent, or Firm* — Philip H. Von Neida

(57) ABSTRACT

A process for the jet milling of particles where water vapor is added to the jet milling system. The temperature, pressure and relative humidity of the water vapor is maintained and adjusted to ensure that the water vapor present during micronization is greater than allowed under equilibrium conditions, but remains above its Wilson point.

13 Claims, No Drawings

NONEQUILIBRIUM HUMIDITY CONTROL FOR JET MILLING

CROSS REFERENCE TO RELATED APPLICATIONS

The present application claims priority from U.S. provisional application Ser. No. 61/152,047 filed Feb. 12, 2009.

BACKGROUND OF THE INVENTION

The present invention relates to an improved method of production of micronized material in a jet milling operation. More particularly, the present invention relates to the use of a humidified gas stream at a controlled temperature, pressure and relative humidity to achieve the maximum nonequilibrium moisture levels in the jet milling operation without the generation of a spontaneous water condensation shock.

Jet milling is a widely used technique, especially in the pharmaceutical industry for the production of fine particles through a micronization process. The development over the years of the many different milling technologies led to the appearance between the 1930's and 1940's of the first jet mills. During the period following World War II, jet milling technology was used for a variety of applications, including pesticides and pigments. The original principles of jet milling are feeding powder particles into the flat cylindrical milling chamber tangentially through a venturi system by pressurized air or nitrogen. The particles are accelerated in a spiral movement inside the milling chamber by a number of nozzles placed around the periphery of the chamber.

The micronizing effect takes place by the collision between the incoming particles and those already accelerated into the spiral path. While centrifugal force retains the larger particles at the periphery of the milling chamber, the smaller particles exit with the exhaust air from the center of the chamber. The particle size distribution is controlled by adjusting a number of parameters, two of the main ones being: pressure and feed rate.

In a jet milling operation, a supersonic nozzle with supply pressures of about 6 to 12 barg nitrogen entrains a feed gas containing material to be milled. The actual milling operation occurs downstream of the nozzle at close to atmospheric pressure, and has a time duration measured in milliseconds. The ultimate outlet temperature of the jet milling operation is typically at a relatively warm temperature (about room temperature). That is, the gas is introduced into the mill at about room temperature, and exits the mill at about room temperature. In between, the gas will change temperature significantly as it exits the supersonic nozzle (lower pressure and temperature) and is subsequently warmed by the energy released in the jet milling operation.

It is considered advantageous to perform the micronization process with humidified gas (typically air or nitrogen) to produce the best particles in terms of size, stability and other valuable properties. It is further considered advantageous to maximize the amount of water vapor present during the micronization process, without producing liquid condensate. The present inventor has discovered a method to maximize the amount of non-condensed water present in the gas stream participating in the micronization process.

SUMMARY OF INVENTION

In a first embodiment of the present invention, there is disclosed a method for milling of particles in a jet milling process comprising introducing water vapor into said process in an amount that does not generate a water condensation shock.

In another embodiment of the present invention, there is disclosed a method for milling of particles in a jet milling process comprising introducing water as water vapor into the process without producing water condensate.

In a further embodiment of the present invention, there is disclosed a method for milling of particles in a jet milling process comprising introducing water vapor into said process under conditions that maintain the water vapor above the Wilson point.

Alternatively, there is disclosed a method for introducing water vapor into a jet milling process comprising controlling the temperature, pressure and relative humidity of said water vapor so that the temperature of said water vapor is above the Wilson point for said water vapor.

In yet another further embodiment of the present invention there is disclosed a method of jet milling comprising introducing water vapor above its Wilson point into said jet milling system.

In the processes of the present invention, water vapor is introduced to the jet milling operation by supplying a humidified gas stream through a convergent-divergent tube or tubes. The effects of the water vapor on the jet milling process will improve the final produced jet milled particle. The desire is to maximize the amount of water vapor that is present in the jet milling system while at the same time avoiding the condensation of the water vapor. This condensation will dramatically reduce the amount of water vapor present during micronization which is considered critical to optimum particle characteristics.

The present inventor has discovered that this maximum water vapor level achieved during the micronization process can be achieved by adjusting the temperature, the pressure and the relative humidity of the higher pressure gas stream supplying the jet milling process. These adjustments will be made to ensure that the water vapor remains above its Wilson point during the micronization process so that the water will remain in the vapor state and not condense out in the jet milling process.

DETAILED DESCRIPTION OF THE INVENTION

The present inventor has discovered a process for maximizing the amount of non-condensable water entering a jet milling system.

The temperature of a water/vapor/nitrogen stream immediately downstream of the supersonic nozzle (but upstream of the jet mill vortex region where micronization and large amounts of energy release occurs will be at a significantly reduced temperature. In an ideal, isentropic nozzle, the temperature may drop by over 100° C. For example, at 10 bara and 20° C., an isentropic expansion of nitrogen to 1 bara will result in a temperature of −122° C. In practice, the nozzles are not ideal and there can be entrainment of the material to be micronized in some nozzles, which reduces the amount of temperature drop considerably. Nevertheless, the temperature will be low enough to condense water vapor under equilibrium thermodynamic conditions. However, the process is fast enough that nonequilibrium thermodynamics must be considered. Looking only at the water vapor portion of the inlet stream (i.e., using the water vapor partial pressure), then the water vapor can be cooled to about 30 to 50° C. below its condensation temperature, without condensation occurring spontaneously. This is the so called Wilson point, as seen for example in "Two-Phase Steam Flow in Turbines and Separators", edited by Moore and Sieverding, pgs. 151-153.

At rapid temperature reductions below the Wilson point, which depends on the local pressure, composition and rate of expansion, then condensation will occur spontaneously. This spontaneous condensation is termed a condensation shock. Equilibrium condensation, even without a condensation shock, will take place eventually, but will take a relatively long period of time (measured in time scales much greater than the typical residence time in a jet mill of a few milliseconds. The location of the Wilson point for the specific operation conditions is based on empirical and semi-theoretical analysis. However, it is related to the amount of equilibrium wetness that can occur downstream of a condensation shock (equilibrium wetness is defined as the hypothetical wetness that will be produced in an adiabatic equilibration process), which is about 3% wetness. That corresponds to about 30 to 50° C. subcooling at the low pressures associated with the present invention.

The advantageous exploitation of this understanding of the process is to supply the jet mill humidified gas, which is typically nitrogen at a combination of temperature, pressure and relative humidity such that at the maximum temperature depression downstream of the nozzle or nozzles, but upstream of the core jet milling vortex, the humidified gas stream is warmer than the Wilson point associated with the operating conditions. This ensures that the maximum amount of water vapor is present throughout the jet milling operation but without condensation (liquid water) forming. If a condensation shock were to occur, then the amount of water vapor present is dramatically reduced and the advantageous features of micronization with a humidified gas stream is significantly reduced. It may be advantageous to accomplish this through a combination of incoming water vapor (relative humidity control), as well as inlet temperature which can raise or lower the minimum temperature achieved downstream of the nozzle, and incoming pressure which also changes the minimum temperature achieved downstream of the nozzle. One advantageous method for producing the stable humidified gas stream is shown in co-pending application Ser. No. 61/152,023 filed on Feb. 12, 2009, the contents of which are wholly incorporated by reference thereto.

While this invention has been described with respect to particular embodiments thereof, it is apparent that numerous other forms and modifications of the invention will be obvious to those skilled in the art. The appended claims in this invention generally should be construed to cover all such obvious forms and modifications which are within the true spirit and scope of the invention.

Having thus described the invention, what I claim is:

1. A method for milling of particles in a jet milling process comprising introducing water into said process through a convergent-divergent tube in an amount beyond the limits allowed in equilibrium conditions without generating a water condensation shock wherein said water is cooled to about 30 to 50° C. below its condensation temperature.

2. The method as claimed in claim 1 wherein said water remains in its vapor state.

3. The method as claimed in claim 1 wherein said process has an equilibrium wetness below about 3% wetness.

4. The method as claimed in claim 1 wherein said water is fed with a non-condensing gas.

5. A method for milling of particles in a jet milling process comprising introducing water as water vapor into the process through a convergent-divergent tube in an amount beyond the limits allowed in equilibrium conditions without producing water condensate, wherein said water vapor is cooled to about 30 to 50° C. below its condensation temperature.

6. The method as claimed in claim 5 wherein said water remains in its vapor state.

7. The method as claimed in claim 5 wherein said process has an equilibrium wetness below about 3% wetness.

8. The method as claimed in claim 5 wherein said water is fed with a non-condensing gas.

9. A method for milling of particles in a jet milling process comprising introducing water vapor into said process through a convergent-divergent tube in an amount beyond the limits allowed in equilibrium conditions under conditions that maintain the water vapor above the Wilson point, wherein said water vapor is cooled to about 30 to 50° C. below its condensation temperature.

10. The method as claimed in claim 9 wherein said water remains in its vapor state.

11. The method as claimed in claim 9 wherein said process has an equilibrium wetness below about 3% wetness.

12. The method as claimed in claim 9 wherein said water is fed with a non-condensing gas.

13. A method for introducing water vapor into a jet milling process comprising controlling the temperature, pressure and relative humidity of said water vapor so that the temperature of said water vapor is above the Wilson point for said water vapor, wherein said water vapor is cooled to about 30 to 50° C. below its condensation temperature.

* * * * *